US008040213B2

(12) United States Patent
Ashikaga

(10) Patent No.: US 8,040,213 B2
(45) Date of Patent: Oct. 18, 2011

(54) THIN FILM RESISTOR ELEMENT AND MANUFACTURING METHOD OF THE SAME

(75) Inventor: Kinya Ashikaga, Tokyo (JP)

(73) Assignee: Oki Semiconductor Co., Ltd. (JP)

( * ) Notice: Subject to any disclaimer, the term of this patent is extended or adjusted under 35 U.S.C. 154(b) by 308 days.

(21) Appl. No.: 12/382,894

(22) Filed: Mar. 26, 2009

(65) Prior Publication Data

US 2009/0267727 A1 Oct. 29, 2009

(30) Foreign Application Priority Data

Apr. 28, 2008 (JP) ..... 2008-117576

(51) Int. Cl.
*H01C 1/012* (2006.01)

(52) U.S. Cl. ..... 338/314

(58) Field of Classification Search ..... 338/314
See application file for complete search history.

(56) References Cited

U.S. PATENT DOCUMENTS

| | | | | |
|---|---|---|---|---|
| 5,798,684 | A * | 8/1998 | Endo et al. | 338/22 R |
| 5,896,264 | A * | 4/1999 | Bijlenga et al. | 361/106 |
| 2007/0124918 | A1 * | 6/2007 | Su et al. | 29/610.1 |
| 2009/0267727 | A1 * | 10/2009 | Ashikaga | 338/314 |

FOREIGN PATENT DOCUMENTS

| | | |
|---|---|---|
| JP | 2005-136360 | 5/2005 |
| JP | 2006-186038 | 7/2006 |

OTHER PUBLICATIONS

A-S. Porret et al., "Design of High-Q Varactors for Low-Power Wireless Applications using a Standard CMOS Process", IEEE 1999 Custom Integrated Circuits Conference, p. 641-644.

* cited by examiner

*Primary Examiner* — James Harvey
(74) *Attorney, Agent, or Firm* — Rabin & Berdo, PC

(57) ABSTRACT

In order to provide a thin-film resistor and a manufacturing method thereof capable of restraining reduction of a Q-value of varactor by reducing a parasitic capacitance between the resistor and the substrate, the thin-film resistor includes a semiconductor substrate 10 including an integrated circuit 12 having a plurality of electrode pads 14 placed in a distance from each other in the most upper part of a plurality of stacked interconnections, and the integrated circuit 12 having a passivation film 16 formed between the plurality of electrode pads 14; a secondary interconnections 18 electrically connected to the electrode pads 14; an insulating film 20 formed in a place in between the secondary interconnections 18 on the passivation film 16; and a resistor 26 formed 18 in a predetermined place in between the secondary interconnections 18 on the insulating film 20.

10 Claims, 8 Drawing Sheets

THIN FILM RESISTOR ELEMENT AND MANUFACTURING METHOD OF THE SAME

BACKGROUND OF THE INVENTION

1. Field of the Invention

The present invention relates to a thin film resistor element and a manufacturing method thereof, more particularly, to a thin film resistor element and a manufacturing method thereof using the wafer level chip size package technology.

This is a counterpart of Japanese patent application Serial Number 117576/2008, filed on Apr. 28, 2008, the subject matter of which is incorporated herein by reference.

2. Description of the Related Art

Regarding mobile communication equipments, more requests for higher functions and downsizing have been made progressively, and furthermore, development of lower-power-consumption electric components for the mobile communication equipments has become an important problem, in a prediction that stable operations thereof using longer-life batteries and the energy regeneration technology will become necessary.

According to the Japanese Patent Application Laid-Open Publication No. 2006-186038 and No. 2005-136360, the technology for improving packaging density by forming and integrating resistors, inductors, or capacitors in higher density in insulating films, corresponding to the above-mentioned requests.

In addition, to the above-mentioned requests for lower power consumption, LSIs using the CMOS process technology have become remarkable as higher-frequency analog ICs of radio wave communications. In higher-frequency analog LSIs, voltage-controlled oscillators (VCOs) used for local oscillators are blocks consuming extra-large currents, and lower current consumption VCOs are considered to be effective to reduce the power consumption of the whole chip.

However, since the conventional VCOs uses polysilicon formed at the same time as the gate electrodes formed as resistors, the above resistors lie in between in the vicinity of the substrate. That is, parasitic capacitances between the substrate and the resistors are large, and then quality factor (Q-value) of the passive elements of the VCOs decreases.

In a typical VCO, passive elements such as inductors, varactors, or resistors are formed on-chip. Since the VCO oscillates theoretically by resonance caused by LC, the higher Q-value have the inductors and the varactors, the smaller loss has the resonance circuit, and then it becomes possible that an oscillation using smaller current realizes lower power consumption.

As one of the above passive elements, the varactor varies the capacitance by an applied DC bias voltage, and a resistor of around 3000Ω is usually inserted to a control terminal for applying the DC bias voltage in order to prevent high-frequency signal leakage to the above control terminal. In the case where the above resistor has ideal resistor characteristics, the above-mentioned higher Q-value can be obtained.

Generally, polysilicon used for forming gates of transistors is used as the on-chip resistors inserted between the varactors. Since the polysilicon is formed on a lower layer of wafer process, the distance to the substrate is short. Consequently, a parasitic capacitance is equivalently loaded between the grounds points by capacitive connections between the resistors and the substrate. Subsequently, the impedance decreases in higher frequency region, and an apparent Q-value of the varactor decreases.

SUMMARY OF THE INVENTION

The present invention has been made in consideration of the above-mentioned problem, and the object is to provide a thin-film resistor element and a manicuring method thereof that can restrain reduction of the Q-value by reducing a parasitic capacitance between the resistor and the substrate.

Through scrutinizing, it has been found that using thin-film resistors and a manufacturing method thereof as described below can solve the above-mentioned problem, and the above objective has been achieved.

According to the present invention, the above-mentioned thin-film resistor is characterized by comprising a semiconductor substrate including an integrated circuit having a plurality of stacked interconnection layers, a plurality of electrode pads placed in a distance from each other in the most upper part of a plurality of stacked interconnection layers, and a passivation film formed between the plurality of electrode pads, a secondly interconnections electrically connected to the above electrode pads, an insulating film formed in a place in between the secondly interconnections on the passivation film, and a resistor formed in a predetermined place in between the secondly interconnections on the insulating film plane.

The above-mentioned thin-film resistor manufacturing method is characterized by comprising a first step of forming an integrated circuit having a plurality of stacked interconnection layers, a plurality of electrode pads placed in a distance from each other in the most upper part of a plurality of stacked interconnection layers, and a passivation film formed between the plurality of electrode pads, and of patterning so as to expose the surface of the electrode pads after forming the insulating film on the electrode pads and on the passivation film, a second step of stacking a resistor layer on the exposed electrode pads and the insulating film, a third step of forming the secondly interconnections after forming a first resist through the intermediary of the resistor layer on the insulating film, and a forth step of forming a second resist through the intermediary of the resistor layer in a predetermined place for the resistor of the insulating film after removing the first resist, and a fifth step of removing the second resist after removing the exposed resistor layer not coated with the second resist.

The present invention can provide a thin-film resistor and a manufacturing method thereof having a capability of reducing parasitic capacitances between the resistors and the substrate without increasing the Q-value of the varactors.

BRIEF DESCRIPTION OF THE DRAWING

The above and other objects and new features of the present invention will become readily apparent from the following detailed description with reference to the accompanying drawings, wherein.

DETAILED DESCRIPTION OF THE PREFERRED EMBODIMENTS

Embodiments of the present invention will be explained in details with reference to the accompanying drawings, as below. The drawings generally show shapes, dimensions, and arrangements of the elements at least to the extent of understanding the present invention, and the present invention is not limited to the drawings.

First Embodiment (Thin-Film Resistor Element)

Figures 1A, 1B:
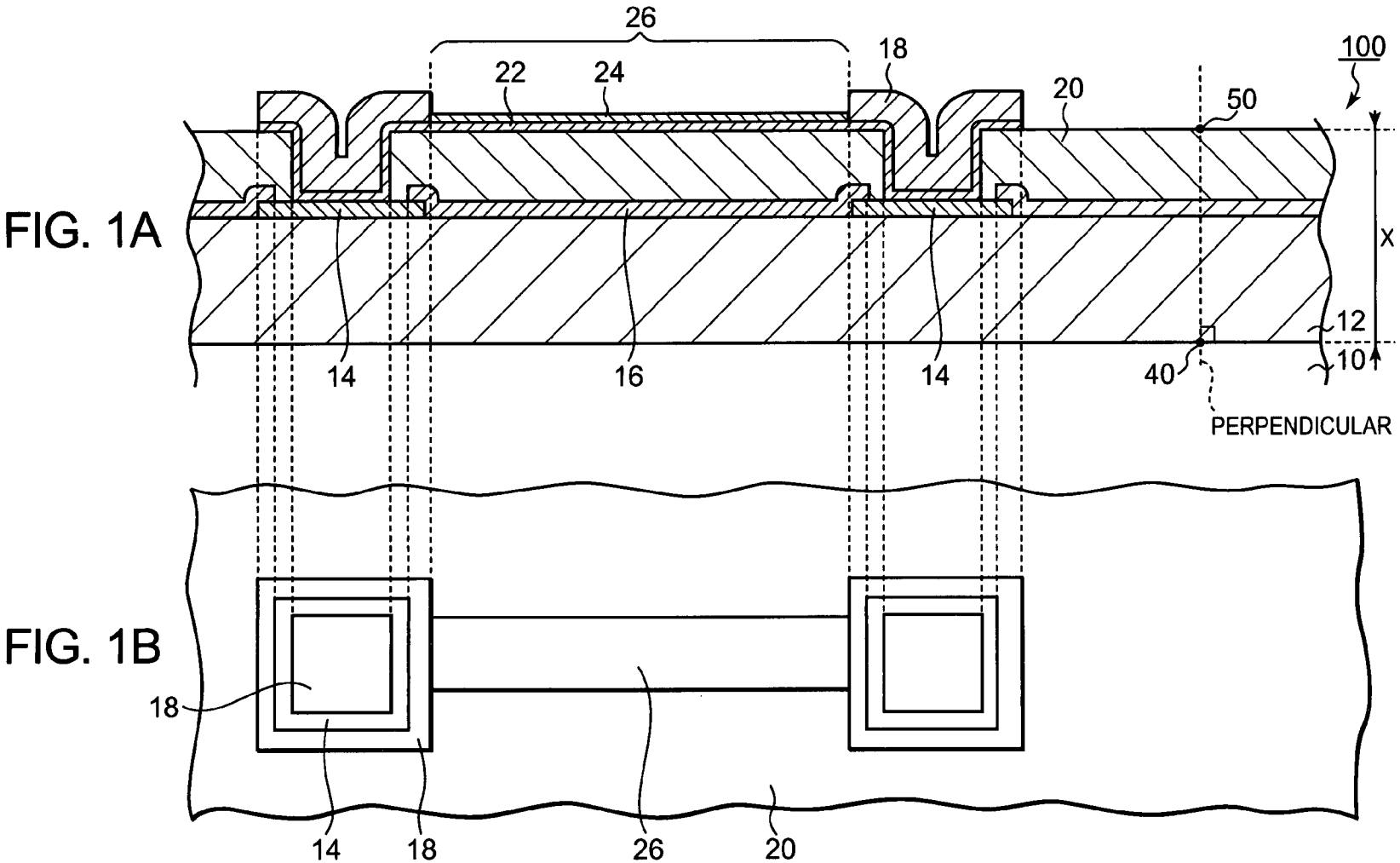
FIG. 1(A) is a general cross section of a FIG. 5 is a view of control-voltage dependence of the Q-values of a varactor using a thin-film resistor of the present invention and the conventional varactor.
FIG. 1(B) is a general perspective top view of thin-film resistor element according to the first embodiment of the invention.

FIG. 1(A) is a general cross section of a thin-film resistor 100 according to the first embodiment of the invention, and FIG. 1(B) is a general perspective top view of FIG. 1(A). On a semiconductor substrate 10, an integrated circuit 12 having a plurality of interconnection layers stacked thereon is formed. In the most upper part of the integrated circuit 12, a plurality of electrode pads 14 are placed in a distance from each other, and a plurality of passivation films 16 are formed between the passivation films 16. To the electrode pads 14, secondary interconnections 18 are connected in the intermediate of a barrier metal layer 22. In addition, an insulating film 20 is formed in a place in between the secondary interconnections 18 on the passivation film 16. Furthermore, a resistor 26 is formed in a predetermined place in between the secondary interconnections 18 on the insulating film 20.

In other words, the thin-film resitor of the present invention is characterized by a configuration that the distance between the resistor 26 and the semiconductor substrate 10 is made as large as possible. Since the above-motioned configuration can restrain increasing of a parasitic capacitance caused by capacitive connection between the semiconductor substrate 10 and the resistor 26, decreasing of the Q-value of the varactors can be restrained.

It is preferable that the thin-film resistor of the present invention is used mainly for a voltage-controlled oscillator (hereinafter referred as "VCO" accordingly". The VCO is a circuit block being used for a local oscillator of a high-frequency analog LSI and consuming a large current.

Figure 2:
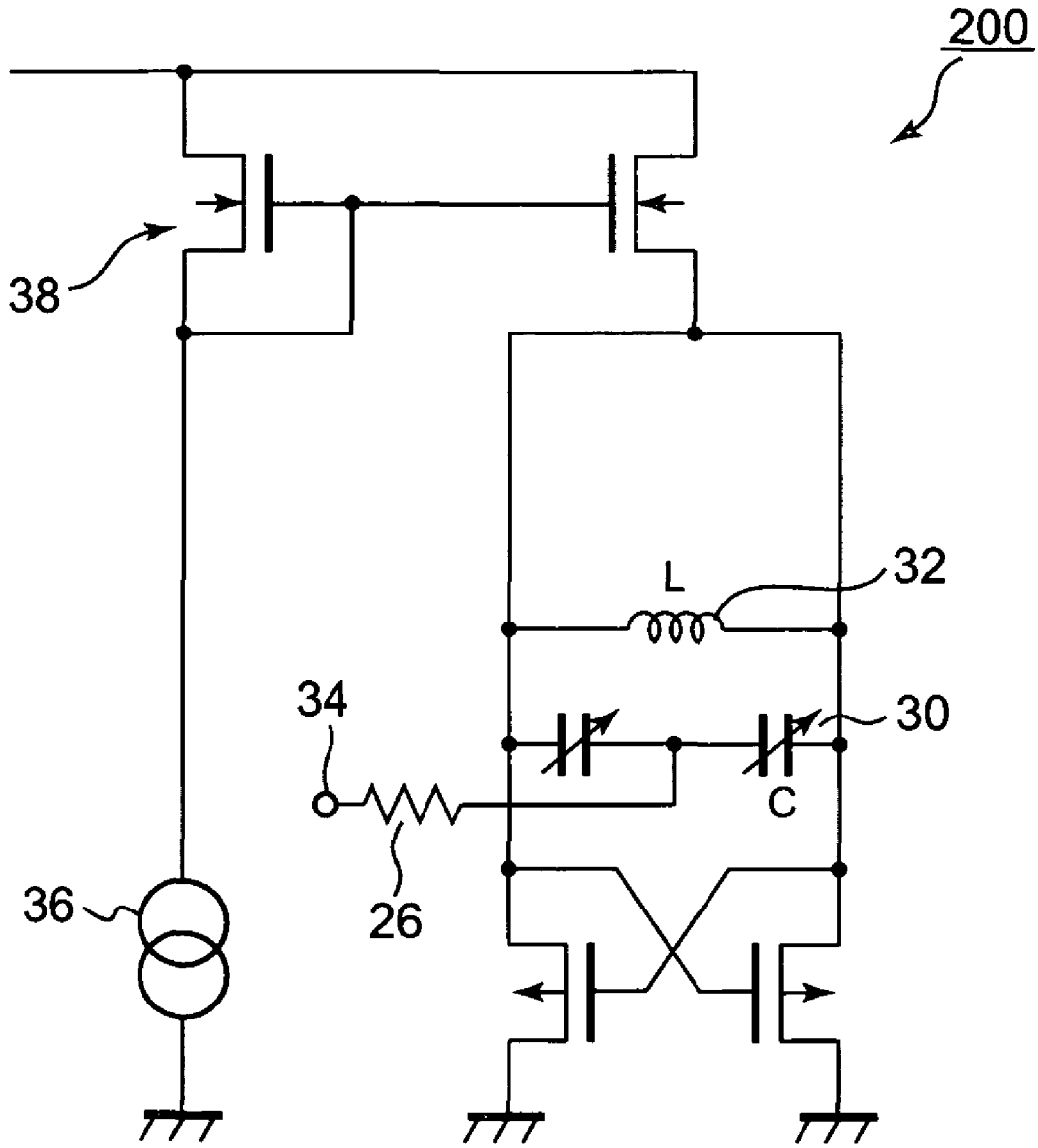
FIG. 2 is a circuit diagram of a core part of a typical VCO.

Subsequently, FIG. 2 shows a circuit diagram of typical core part of the VCO. In FIG. 2, an inductor 32, a varactor 30, and a resistor 26, etc. are formed using the on-chip technology. Since the VCO oscillates in theory by resonance caused by LC, the higher O-value the inductor 32 and the varactor 30 have, the smaller loss the resonance circuit has, and then it becomes possible that an oscillation using smaller current realizes lower power consumption. The varactor varies the capacitance by the applied DC bias voltage, and a resistor of around 3000Ω is usually inserted to a control terminal for applying the DC bias voltage in order to prevent high-frequency signal leakage to the control terminal. In order to the varactor has an ideally high Q-value, the resistor 26 needs to have ideal resistor characteristics.

The relationship between the parasitic capacitance arising between the resistor 26 and the semiconductor substrate 10 and the Q-value of the varactor 30 will be explained in details as follows.

Figure 3A:
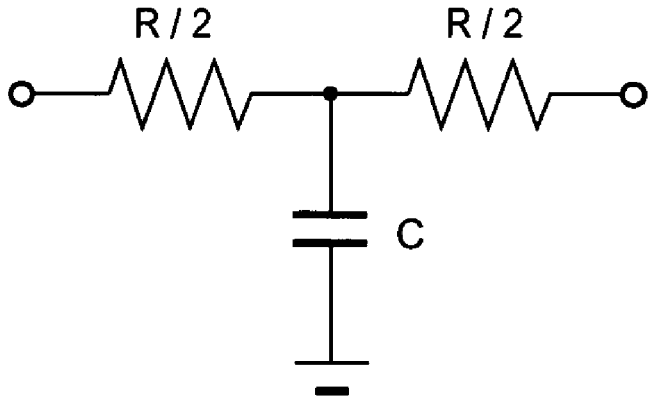
FIG. 3(A) is a view of the simplest equivalent circuit of a resistor in a VCO.
Figure 3B:
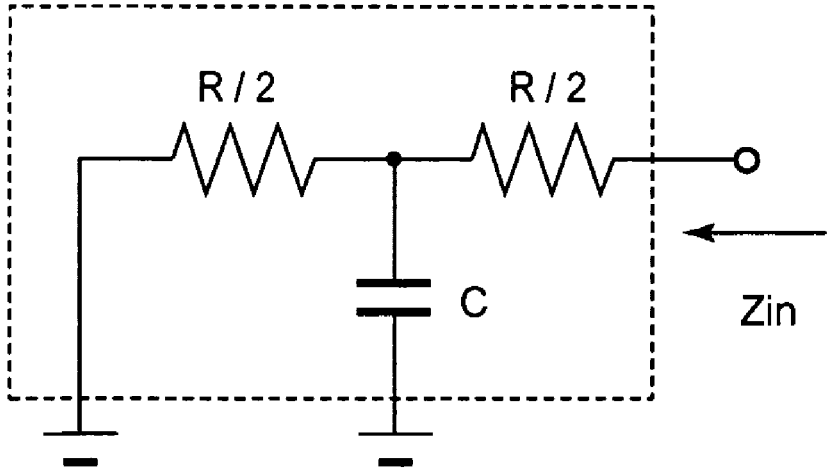
FIG. 3(B) is a circuit diagram for evaluation of the impedance by the parasitic capacitance in FIG. (A)

A circuit of FIG. 3(A) shows the simplest equivalent circuit model of the resistor 26 of the VCO. In the above model, a frequency dependence of an impedance Zin caused by the parasitic capacitance C is observed from one end by connecting another end of two terminals to the ground, as shown in FIG. 3(B).

Figure 4:
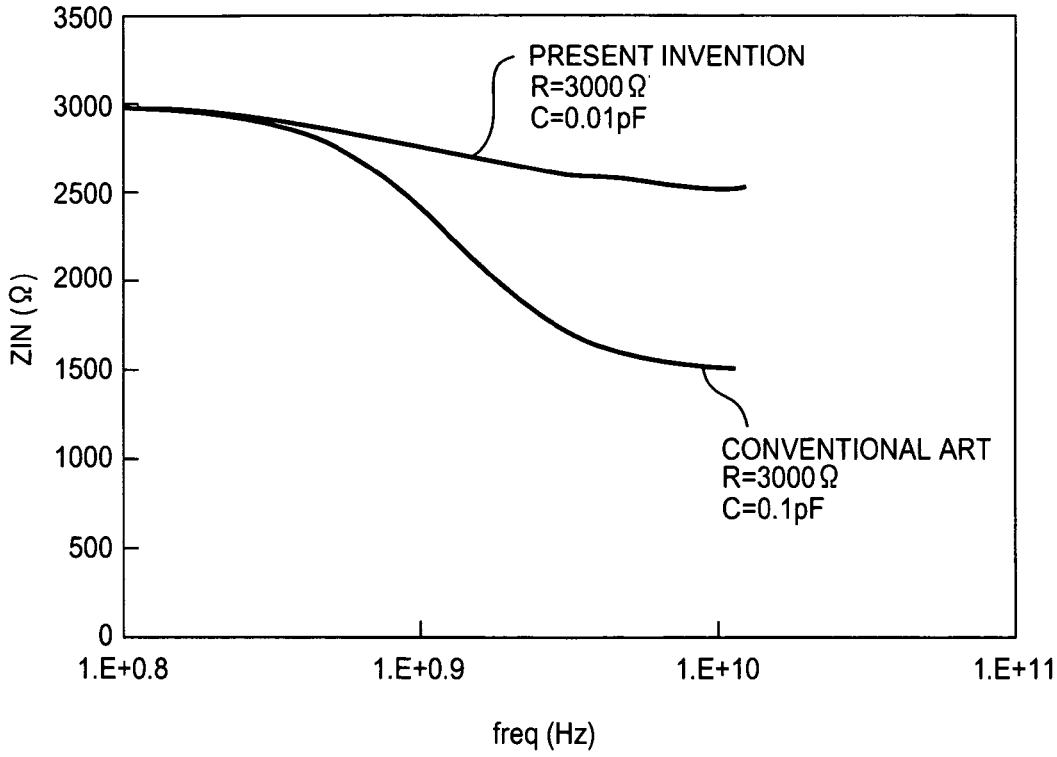
FIG. 4 is a view of frequency dependence of the impedances of a thin-film resistor element of the present invention and the conventional thin-film resistor element.

Since a distance between the semiconductor substrate and the resistor is small, as shown in FIG. 4, it is found from the observation that the impedance decreases in higher frequency region on the condition that the parasitic capacitance c is 0.1 pF, and the resistor R is 3000Ω. In other words, a high frequency leakage apparently reduces the Q-vale of the varactor. Meanwhile, in the case of the thin-film resistor of the present invention, since the semiconductor substrate and the resistor are formed in a distance, the impedance reduction thereof in higher frequency region can be restrained on the condition that the parasitic capacitance c is 0.1 pF, and the resistor R is 3000Ω, as shown in FIG. 4. That is, the reduction of the Q-value can be restrained because there is no high frequency leakage.

As a configuration easy to make the above effect, it is preferable to form the resistor 26 and the semiconductor substrate 10 in a distance of more than 10 μm.

The above-mentioned distance between the resistor 26 and the semiconductor substrate 10 is a distance x between a contact point 40 between a perpendicular of the semiconductor substrate 10 and a plane on the integrated circuit 12 side of the semiconductor substrate 10 and a contact point 50 between the above perpendicular and a plane on the insulating film 20 side of the resistor 26, as shown in FIG. 1(A). In the case where the distance x is more than 10 μm, since the above parasitic capacitance becomes a very low value of around less than 0.01 pF, the reduction of the Q-value of the varactor can be restrained. Consequently, in the case where the distance x is more than 10 μm, no specific distance value is necessary. Also, as the upper limit of the distance, no specific distance value is necessary, as long as the distance can respond to a request for a thinner device.

The resistor and the insulating film used in the thin-film resistor element according to the present invention will be explained in details as follows.

A resistor used for a thin-film resistor of the invention can be formed separately on the insulating film 20, or can have a configuration where two layers of the barrier metal layer 22 and a seed layer 24 are sequentially stacked, as shown in FIG. 1(A). The above two layers are layers conventionally used for forming the secondary interconnections 18.

The barrier metal layer 22 is a layer for increasing adhesiveness between the electrode pad 14 and the secondary interconnection 18. A material of the above barrier metal layer 22 can be selected accordingly to the material of the electrode pad 14 or the secondary interconnection 18, and Ti, TiN, Ni, etc. can be taken as an example. The seed layer 24 is a layer used as an electrode for forming the secondary interconnection 18 by a plating method. Therefore, it is preferable to use a low-resistance material; it is more preferable to use the same material as the material of the secondary interconnection 18, and Cu, Al can betaken as an example. A thickness of the seed layer 24 does not need to have a specific value as long as the thickness allows the secondary interconnection 18 to be formed by a plating method.

As explained before, a configuration consisting of the barrier metal layer 22 and the seed layer 24 can be taken as an example for forming the resistor 26. Also, a resistance of the resistor 26 can be adjusted accordingly by the thickness of the above layers.

Regarding the thin-film resistor element of the invention, in order to form the above-mentioned resistor 26 in a long distance as possible from the semiconductor substrate 10, an insulating film is further formed on the integrated circuit and the resistor 26 is formed on the insulating film. In other words, the thicker the thickness of the insulating film has, the longer the distance between the resistor 26 and the semiconductor substrate 10 becomes, and then it becomes possible to reduce the parasitic capacitance arising between the resistor 26 and the semiconductor substrate 10.

The thickness of the above insulating film having a value more than 5 μm is preferable. Also, as the upper limit of the thickness, no specific thickness value is necessary, as long as the thickness can respond to a request for a thinner device.

Furthermore, as a material of the insulating film, conventionally-used polymide resin, epoxi resin, etc. can be used.

Figure 5:
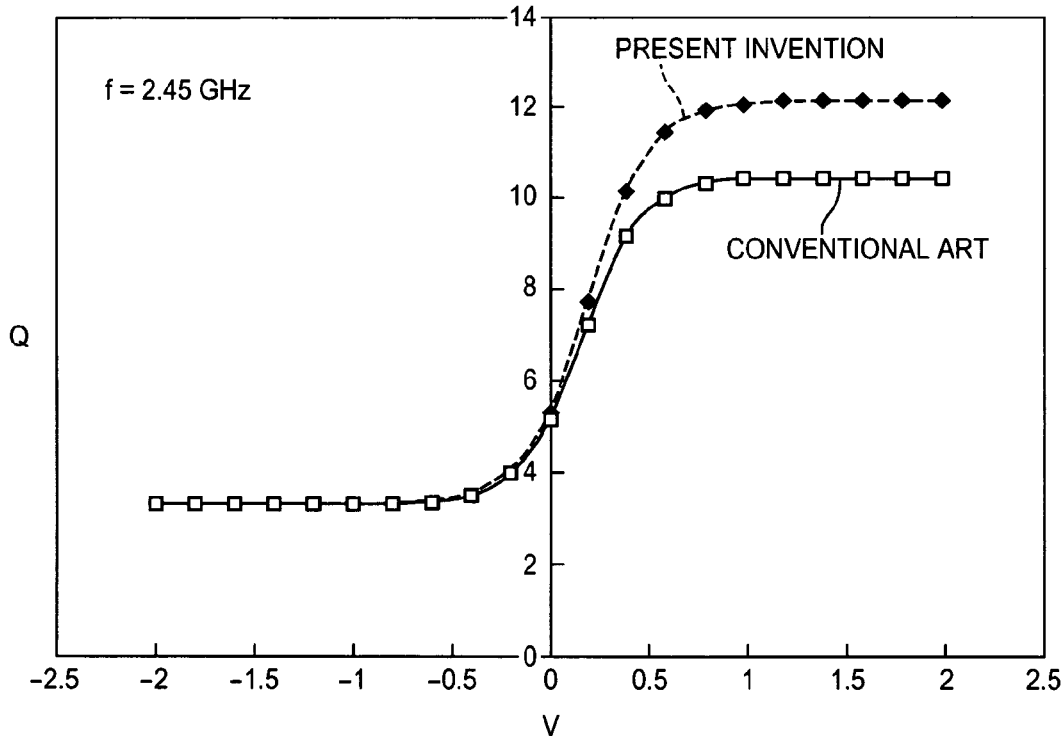
FIG. 5 is a view of control-voltage dependence of the Q-values of a varactor using a thin-film resistor element of the present invention and of the conventional varactor

An examination result of the control-voltage dependence of the Q-values of two MOS varactors is shown in FIG. 5. The first MOS varactor is the MOS varactor using the thin-film resistor element of the invention having the above-mentioned configuration, and the second MOS varactor is the MOS varactor using the conventional thin-film resistor element having a polysilicon resistor formed at the same time as the formation of the gate electrode. The thin film resistor element of the present invention uses a configuration where the resistor is formed in a distance of 10 μm from the semiconductor substrate and the resistor has resistance of 2000Ω. Also, the conventional thin-film resistor element has a configuration where the polysilicon of the resistor is formed in a distance of 0.2 μm from the semiconductor substrate and the resistor has resistance of 2000Ω. Furthermore, since the Q-vale of the MOS varactor influences on the Q-value in higher frequency region according to the result shown in FIG. 4, the Q-value is observed at 2.45 GHz.

As shown in FIG. 5, the MOS varactor using the thin film resistor element of the present invention increases the Q-value by around not less than 20% compared with the conventional MOS varactor by forming the resistor and the semiconductor substrate in a long distance from each other as possible.

Second Embodiment (Thin-Film Resistor Element)

A thin film resistor element of the second embodiment has a configuration where the seed layer 24, which composes the resistor 26 of thin-film resistor element of the first embodiment, is not formed, and the resistor 26 is composed only with the barrier metal layer 22.

As explained before, since it is preferable that the seed layer is formed by the same material as the secondary interconnections, the resistance of the resistor is small. Therefore, the resistance decreases in the case of including the seed layer, and then a resistor having a further higher resistance becomes necessary accordingly to the VCO specification. In the above case, there is some possibility that a required resistance cannot be obtained due to the seed layer even when the resistance of the resistor increases by increasing the thickness of the barrier metal layer. In order to obtain the higher resistance, only the barrier metal layer 22 can compose a resistor 26 without the seed layer 24 having a lower resistance. A further higher resistance can be obtained by increasing the thickness of the barrier metal layer 22.

In addition, the thin-film resistor element of the second embodiment can restrain the reduction of the Q-value of the varactor because the semiconductor substrate and the resistor are formed in a distance as in the first embodiment, and then it is obvious that the same result can be obtained as in FIG. 5.

First Embodiment (Thin-Film Resistor Manufacturing Method)

A manufacturing method of the thin-film resistor element according to the first embodiment is characterized by using a layer used for forming the secondary interconnections as a resistor. In other words, in the conventional case where a polysilicon is used for the resistor, the polysilicon needs to be separately formed in order to obtain an enough distance between the semiconductor substrate and the resistor. Meanwhile, according to the present invention, a step of forming the resistor can be omitted by using a layer conventionally used for forming the secondary interconnections as the resistor.

A manufacturing method of a thin-film according to the present invention will be explained in details with reference to the process cross section of FIG. 6. Accordingly, the manufacturing method will be explained with reference to the process top-views of FIG. 7, FIG. 8.

Figure 6A:
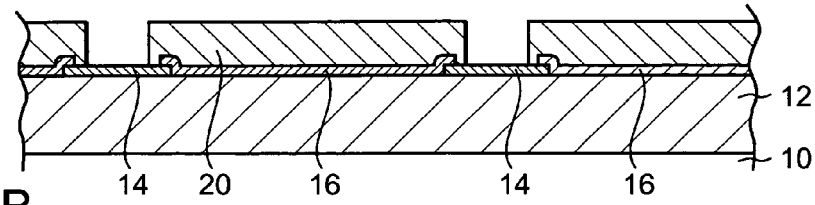
FIG. 6A-6E is a process cross section of a thin-film resistor element according to the first embodiment of the invention.

The first step of the present invention is a step of patterning the electrode pad 14 so as to expose the surface thereof after forming the integrated circuit 12 having the plurality of electrode pads 14 placed in a distance from each other in the most upper part of the plurality of stacked interconnections and the passivation film 16 formed between the plurality of electrode pads 14, and forming the insulating film 20 on the electrode pads 14 and the passivation film 16. First, through a final wafer process, the integrated circuit 12 is formed by placing a plurality of electrode pads in a distance from each other and forming the passivation film 16 on the semiconductor substrate 10. Since the above passivation film 16 is formed using photolithography and dry etching so as to make an aperture in a part of the surface of the electrode pad 14 after the passivation film 16 is stacked on the electrode pads 14 and the integrated circuit 12, an edge of the passivation film 16 is formed so as to cover an edge of the electrode pad 14, as shown in FIG. 6(A).

Figure 7A:
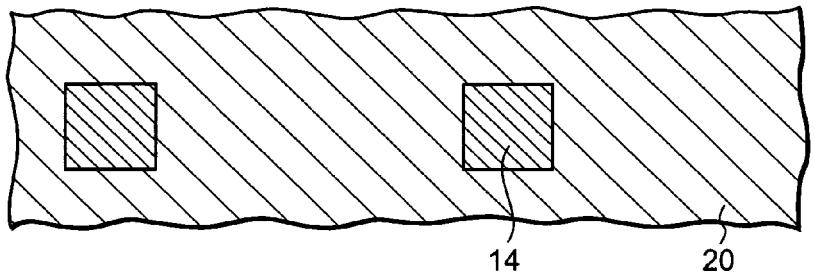
FIG. 7A-7D is a process top view of a thin-film resistor element according to the first embodiment of the invention.
Figure 7B:
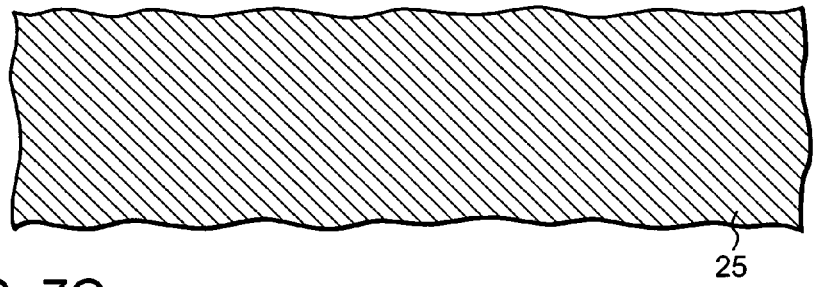
Figure 8:
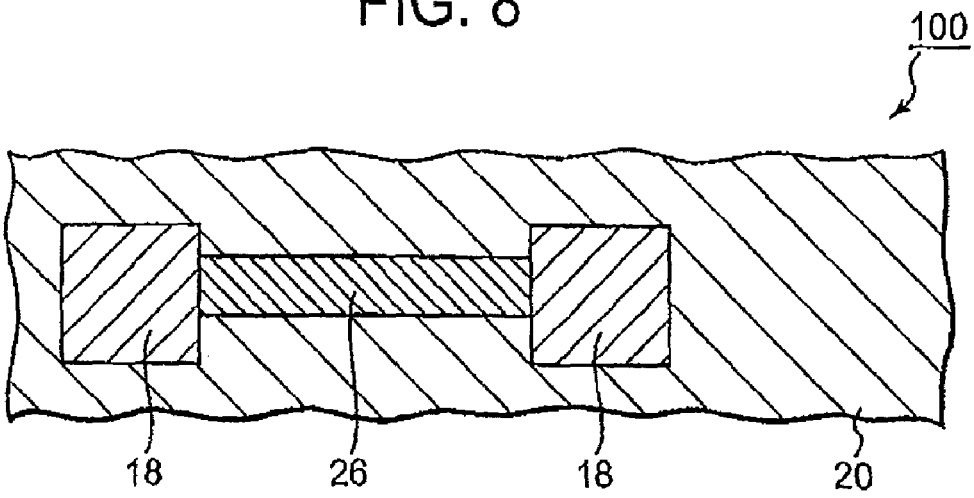
FIG. 8 is a process top view of a thin-film resistor element according to the first embodiment of the invention.

Subsequently, the insulating film 20 is formed on the electrode pads 14 and the passivation film 16, an aperture is made the surface of the electrode 14 by photolithography and dry etching. In the above process, the insulating film 20 is formed so as to cover the passivation film 16 so that the secondary interconnections (not shown in FIG. 6(A)) formed on the electrode pads 14 and the passivation film 16 are not electrically connected. The material and the thickness of the insulating film 20 are the same as in the aforementioned case. FIG. 7(A) is a general top view of the formed insulating film 20. As shown in FIG. 7(A), the insulating film 20 is formed so as to expose the surface of the electrode pad 14.

The second step of the present invention is a step of stacking a resistor layer on the exposed electrode pad 14 and the insulating film 20.

Figure 6B:
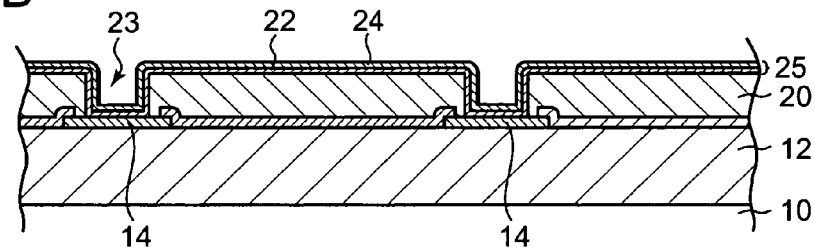

As shown in FIG. 6(B), the resistor layer 25 is formed on the insulating film 20 and the electrode pad 14 by the publicly-known sputtering method. In the above step of forming the resistor layer 25, it is preferable that the barrier metal layer 22 and the seed layer 24 are sequentially stacked. In the above configuration, the barrier metal layer 22 has a function of improving an adhesiveness between the secondary interconnection layer (not shown in FIG. 6(B)) and the electrode pad, and the seed layer 24 has a function of plating electrode for forming the secondary interconnection layer, as explained before, In addition, since the above layers composes the resistor described below, a step of forming the resistor separately in the conventional manufacturing method can be omitted. Also, since the barrier metal layer 22 and the seed layer 24 have the aforementioned functions, the layers are stacked in the order of the barrier metal layer and the seed layer 24. Thickness and materials of the above layers are the same as described before.

The third step of the present invention is a step of forming the secondary interconnections 18 after forming a first resist 27 on the insulating layer 20 through the intermediary of the resistor layer 25.

Figure 6C:
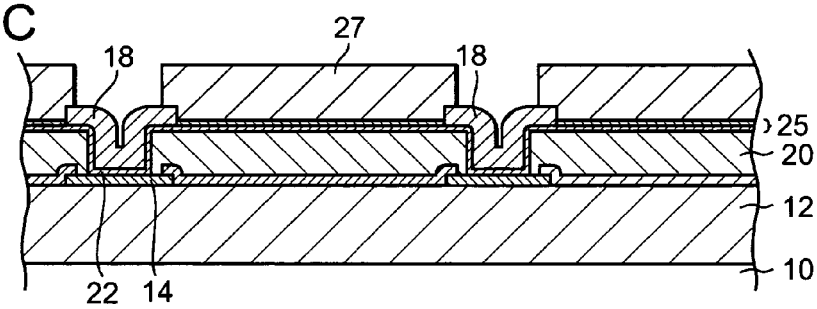
Figure 7C:
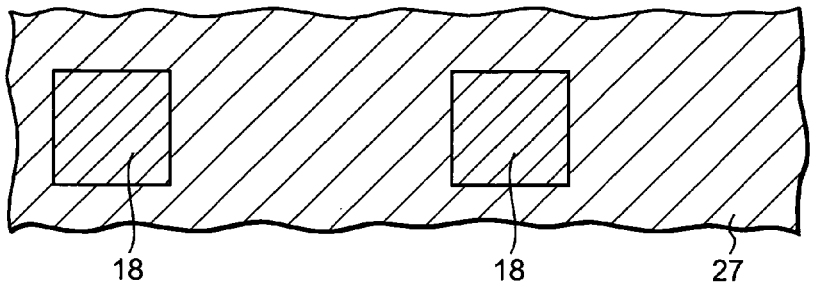

As shown in FIG. 6(C), the resist is coated on the resistor layer 25 and patterning is performed so as to eliminate regions of the secondary interconnections. Consequently, the first resist 27 can be formed on the insulating layer 20 through the intermediary of the resistor layer 25. Subsequently, the secondary interconnection 18 is formed by the plating method using the exposed layer 24 as the electrode. FIG. 7(C) is a general top view after formation of the secondary interconnection 18 after patterning the first resist 27.

It is preferable that the width of the first resist 27 is smaller than the width of the insulating film 20, as shown in FIG. 6(C). In the case where the width of the first resist 27 is larger than the width of the insulating film 20, since the width of the secondary interconnection 18 becomes smaller than the width of a trench 23 in FIG. 6(B), a contact area between the secondary interconnection 18 and the barrier metal layer 22 reduces and causes a detachment of the secondary interconnection 18.

The forth step of the present invention is a step of forming a second resist 28 at a predetermined location for forming the resistor on the insulating film 20*a* through the intermediary of the resistor layer 25 by removing the first resist 27.

Figure 6D:
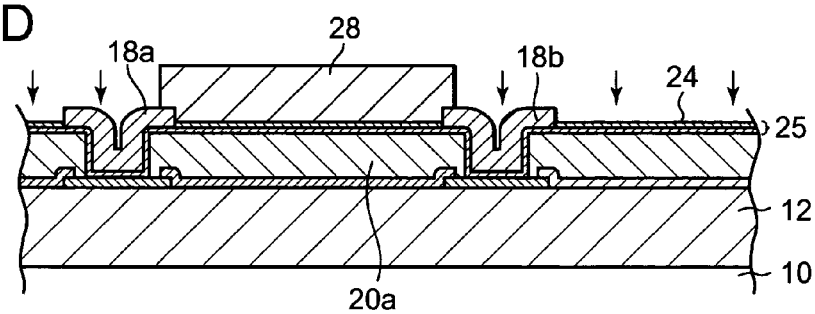
Figure 7D:
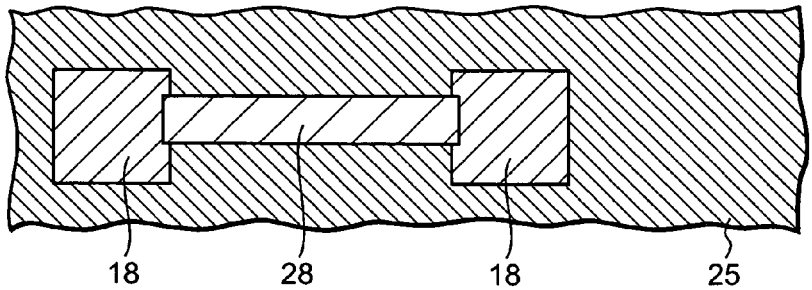

In the above step, the resist is coated on the resistor layer 25 and the secondary interconnection 18 after removing the first resist 27 formed in the process of FIG. 6(C). Subsequently, the second resist 28 is formed by photolithography so as to leave the resist only at the predetermined location on the insulating film 20*a* as shown in FIG. 6(D). FIG. 7(D) is a general top-view of the process when the second resist 28 is formed after the first resist is removed.

In the present invention, it is preferable that the second resist 28 is formed so as to cover the edges of the secondary interconnection 18 as shown in FIG. 6(D). The reason is that since it is difficult to perform the patterning so as to form the second resist at the same interval as the interval between the secondary interconnections 18*a* and 18*b*, and the resistor layer 25 at the predetermined location on the insulating film 20*a* needs to be protected even when the second resist 28 is slightly misaligned. Consequently, it becomes possible that the width of the second resist 28 can be expanded to the location where all the surface of the secondary interconnections 18*a*, 18*b* placed so as to clip the second resist 28 is covered.

The fifth step of the preset invention is a step of removing the second resist 28 after removing the exposed resistor layer 25 not coated with the second resist 28.

Figure 6E:
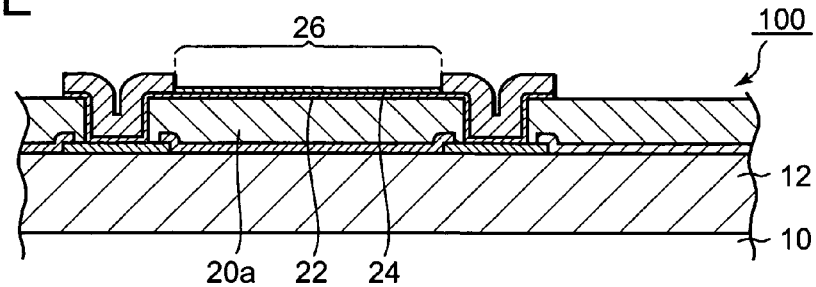

As shown in FIG. 6(E), the resistor layer 25 in the region, in which the second resist 28 formed in the process of FIG. 6(D) is not formed, is removed by the publicly known dry etching method. Subsequently, the resistor layer 26 is formed by removing the second resist 28, and then a thin-film resistor element 100 of the present invention can be formed. FIG. 8(E) is a general top-view of the thin-film resistor element 100 of the present invention.

In the case where the seed layer 24 of the resistor 26 is formed by the same material as the secondary interconnection 18, a problem may arise that since the thickness of the secondary interconnection 18 is reduced only by the thickness of the seed layer 24 in the case of removing the exposed seed layer 24 where the formed second resist 28 is not formed, the resistance of the resistor 18 increases. However, the thickness of the secondary interconnection 18 is thicker than the seed layer 24 and has around several microns. Consequently, even when the thickness of the secondary interconnection 18 is reduced by the thickness of the seed layer 24, the resistance increase only slightly and an influence on the whole VCO caused by the Joule heat, etc. can be neglected.

Second Embodiment

A manufacturing method of the thin-film resistor element according to the second embodiment of the present invention includes a sixth step of removing the seed layer 24 composing the resistor after the aforementioned fifth step, and other steps than the sixth step are the same as the manufacturing method of the thin-film resistor element according to the first embodiment. The seed layer can be removed by the publicly known dry etching method similarly as described before.

In addition, since it is preferable that the seed layer 24 is formed by the same material as the secondary interconnection layer, the thickness of the secondary interconnection is reduced by removing the seed layer. However, the thickness of the secondary interconnection 18 is thicker than the seed layer 24 and has around several microns. Therefore, even when the thickness of the secondary interconnection 18 is reduced by the thickness of the seed layer 24, the resistance increase only slightly and an influence on the whole VCO caused by the Joule heat, etc. can be neglected.

Consequently, the resistance of the resistor can be increased easily by removing the seed layer 24.

What is claimed is:

1. A thin-film resistor element comprising:

a semiconductor substrate including a integrated circuit having a plurality of electrode pads placed in a distance from each other in the most upper part of a plurality of stacked interconnections and the integrated circuit having a passivation film formed between the plurality of electrode pads;

a secondary interconnection electrically connected with the electrode pads;

an insulating film formed in a place in between the secondary interconnections on the passivation film; and a resistor formed in a predetermined place in between the secondary interconnections on the passivation film.

2. The thin-film resistor element of claim 1, wherein the resistor is formed by sequentially stacking a barrier metal film and a seed film.

3. The thin-film resistor element of claim 1, wherein the resistor layer is formed by a barrier metal film.

4. The thin-film resistor element of any one of claim 1, wherein a distance between a contact point between a perpendicular of the semiconductor substrate and a plane on the integrated circuit side of the semiconductor substrate and a contact point between the above perpendicular and a plane on the insulating film side of the resistor is more than 10 μm.

5. The thin-film resistor element of any one of claim 1, wherein a thickness of the insulating film is more than 5 μm.

6. The thin-film resistor element of any one of claim 1 being used for a voltage-controlled oscillator.

7. A manufacturing method of a thin-film resistor element comprising:

a first step of forming a integrated circuit having a plurality of electrode pads placed in a distance from each other in the most upper part of a plurality of stacked interconnections and the integrated circuit having a passivation film formed between the plurality of electrode pads, and the first step of patterning so as to expose the surface of the electrode pads after forming an insulating film on the electrode pads and the passivation film;

a second step of stacking a resistor layer on the exposed electrode pads and the insulating film;

a third step of forming a secondary interconnection after forming a first resist on the insulating film through the intermediary of the resistor layer;

a forth step of forming a second resist in a predetermined place for the resistor on the insulating film after removing the first resist; and a fifth step of removing the second resist after removing the exposed resistor layer not coated with the second resist.

8. The manufacturing method of a thin-film resistor element of claim 7, wherein the second step includes a step of forming a seed layer after forming a barrier metal layer.

9. The manufacturing method of a thin-film resistor element of claim 8, including a step of removing the seed layer after the fifth step.

10. The manufacturing method of a thin-film resistor element of any one of claim 7, wherein the second resist is formed so as to cover edges of the secondary interconnections.

* * * * *